US005501537A

United States Patent [19]

Kohno

[11] Patent Number: 5,501,537

[45] Date of Patent: Mar. 26, 1996

[54] INK RIBBON

[75] Inventor: Nobuo Kohno, Kanagawa, Japan

[73] Assignee: Sony Corporation, Tokyo, Japan

[21] Appl. No.: 279,872

[22] Filed: Jul. 25, 1994

[30] Foreign Application Priority Data

Jul. 30, 1993 [JP] Japan ..... 5-208483

[51] Int. Cl.[6] ..... B41J 31/00

[52] U.S. Cl. ..... 400/240.4; 400/240; 400/120.02; 347/177; 347/178

[58] Field of Search ..... 400/240, 240.4, 400/240.3, 120.04, 120 MP, 120.02, 120.04, 120.03; 347/177, 178

[56] References Cited

U.S. PATENT DOCUMENTS

| | | | |
|---|---|---|---|
| 4,794,404 | 12/1988 | Shiraishi et al. | 400/240.4 |
| 5,037,218 | 8/1991 | Shimizu et al. | 400/237 |
| 5,073,053 | 12/1991 | Kashiwagi | 400/240.4 |
| 5,080,512 | 1/1992 | Schofield et al. | 400/225 |
| 5,104,247 | 4/1992 | Oshima | 400/240.4 |
| 5,144,331 | 9/1992 | Amano | 400/240.4 |
| 5,259,680 | 11/1993 | Shimizu et al. | 400/120.04 |
| 5,325,115 | 6/1994 | Tanahashi | 400/240.4 |

FOREIGN PATENT DOCUMENTS

| | | | |
|---|---|---|---|
| 0045184 | 3/1984 | Japan | 400/120 MP |
| 0171662 | 9/1984 | Japan | 400/120 MP |
| 0073889 | 4/1985 | Japan | 400/120 MP |
| 62-11370 | 1/1987 | Japan . | |
| 0044466 | 2/1987 | Japan | 400/120 MP |
| 64-1086 | 1/1989 | Japan . | |
| 2100673 | 1/1983 | United Kingdom | 400/240.4 |

*Primary Examiner*—Edgar S. Burr
*Assistant Examiner*—Lynn D. Hendrickson
*Attorney, Agent, or Firm*—Ronald P. Kananen

[57] ABSTRACT

A printing unit header finding mark PH1 is formed at the head of the color ink areas Y (yellow), M (magenta), C (cyan), and K (black). Color header finding marks YH, MH, CH, and KH which are respectively formed at the head of the color ink areas Y, M, C, and K have a predetermined length in the longitudinal direction and do not overlap with the printing unit header finding mark PH1 in the ribbon width direction. The head of the printing unit and the color ink areas Y, M, C, and K are accurately detected in accordance with the output of two sensors 2A and 2B. One of the marks PH1, YH, MH, CH, and KH has a length which varies in a manner which indicates the diameter of the ribbon wound on one of the supply and the take-up reels.

17 Claims, 2 Drawing Sheets

INK RIBBON

BACKGROUND OF THE INVENTION

1. Field of the Invention

This invention relates to an ink ribbon. More specifically, this invention relates to an ink ribbon which is applicable to, for example, a printing apparatus for printing color pictures on a printing medium, such as card or the like, using a thermal dye copy system.

2. Description of the Related Art

Heretofore, a card printing apparatus has been proposed (Japanese Patent Application Laid Open No. 11370/1987), in which a plurality of coloring matters for printing made up of dyes, such as yellow, magenta, and cyan which have been applied on an ink ribbon at regular intervals, are thermally transferred by a thermal printing head onto a card type printing medium (hereinafter, referred to as a "card") so as to overlay one on the other, whereby a color picture is printed on the card. This printing is based on color picture information optically read from a color photograph, a color picture picked up by a video camera, or the like.

As shown in FIG. 1, the ink ribbon 1 to be used in the above type of card printing apparatus, is such that the yellow coloring dye Y, the magenta coloring dye M, and the cyan coloring dye C have been respectively arranged at predetermined intervals to make up a printing unit for one page. A unit header mark PH, which has the same width as the ink ribbon 1 and which has a predetermined length H1, is located at the head portion of this particular page printing unit, that is to say, at the head of the yellow coloring dye Y. The magenta color mark MH and the cyan color mark CH which respectively have predetermined lengths H2 and H3 and widths which are half the width of the ink ribbon 1, are located on one side of the longitudinal center of the ribbon, and are arranged at the respective heads of the magenta coloring dye M and the cyan coloring dye C.

The ink ribbon driving system of this card printing apparatus has first and second sensors 2A and 2B which are positioned so as to monitor each half-portion of the ribbon width. Thus, in this ink ribbon driving system, when the first and second sensors 2A and 2B sense the mark at the same time, it is indicated that the head of one page has been detected, while when only the first sensor 2A senses the mark, the head of a color is determined. In this way, the position of a plurality of different colored dye portions can be accurately determined and high quality printing can be performed without the adverse effects of ribbon length and slip, etc.

With this type of card printing apparatus, there are some instances where it is particularly desired to print only black letters or even a bar code (which can be read by a bar code reading unit such as that utilizing an infrared sensor) in addition to the color printing using three colors Y, M, and C. Therefore, an ink ribbon on which a black coloring dye is applied in addition to the yellow coloring dye Y, the magenta coloring dye M, and the cyan coloring dye C, is used.

In such a ink ribbon, a black color mark is put at the head of the black coloring dye. However, this introduces a problem that with only a simple construction, which utilizes only two sensors 2A and 2B to sense the marks and to provide the required timing, it is not possible to distinguish between the black coloring dye and the unit header mark PH. Therefore, it has been proposed that the sensor output obtained from two sensors be processed based on the width of mark used to denote the coloring dyes Y, M, and C to determine the header detection. However, this process complicates the ink ribbon driving system and the associated computation circuitry, and inhibits simplification and miniaturization.

Furthermore, in such a printer, it is extremely helpful if the winding diameter of the ink ribbon can be determined.

SUMMARY OF THE INVENTION

In view of foregoing, an object of this invention is to provide an ink ribbon which ensures the detection of the head of a printing unit and the head of each color ink area, and which enables both simple construction and high quality printing.

Another object of this invention is to provide an ink ribbon wherein the winding diameter can be detected using only a simple construction.

The foregoing objects and other objects of the invention are achieved by the provision of an ink ribbon 10 for printing on a predetermined printing medium 18 by a printing head 17, which is positioned between a supply reel 12 and a take-up reel 16, while being wound off the supply reel 12 and being taken up by the take-up reel 16, and which has at least three different kinds of color inks provided thereon.

In accordance with the present invention, this ink ribbon is characterized by a printing unit header finding mark PH1 which is formed at the head of at least three kinds of color ink areas Y, M, C, and K that respectively contain three kinds of color inks which extends the ribbon width and which have a predetermined length in the longitudinal direction. This ribbon further features color header finding marks MH, CH, and KH which are respectively formed at the heads of the color ink areas M, C, and K, and which are not associated with the unit header finding mark PH1. Each of these marks has a predetermined length in the longitudinal direction and is formed in a second portion of the ribbon which does not overlap with the printing unit header finding mark PH1 in the ribbon width direction.

The printing unit header finding mark PH1 is formed in a first half-portion of the ribbon so as to be at the head of at least three kinds of color ink areas Y, M, C, and K on which at least three kinds of color inks are applied. The printing unit header finding mark PH1 extends in the ribbon width direction and has a predetermined length in the longitudinal direction. Further, the color header finding marks MH, CH, and KH are respectively formed at the heads of the color ink areas M, C, and K and are not associated with the printing unit header mark PH1. These marks have a predetermined length in the longitudinal direction of the ribbon and are formed in a second portion of the ribbon and so as to not overlap with the printing unit header finding mark PH1 in the ribbon width direction. Therefore, the heads of the printing unit and the color ink areas Y, M, C, and K can be surely detected in accordance with the output of the two sensors 2A and 2B which are positioned to monitor the first and second width portions of the ribbon.

One of the printing unit header marks PH1 and the color header finding marks YH, MH, CH and KH is arranged to have a length which changes along the length of the ribbon and which is arranged to be determined in accordance with a diameter of the ink ribbon wound around said supply reel or the take-up reel. In other words, the length of each mark which is chosen to indicate the diameter of the ribbon is different from each of the other corresponding marks and such as to indicate the current diameter of the ribbon on the selected spool.

The nature, principle and utility of the invention will become more apparent from the following detailed description when taken in conjunction with the accompanying drawings in which like parts are designated by like reference numerals or characters.

DETAILED DESCRIPTION OF THE EMBODIMENT

Figure 1:
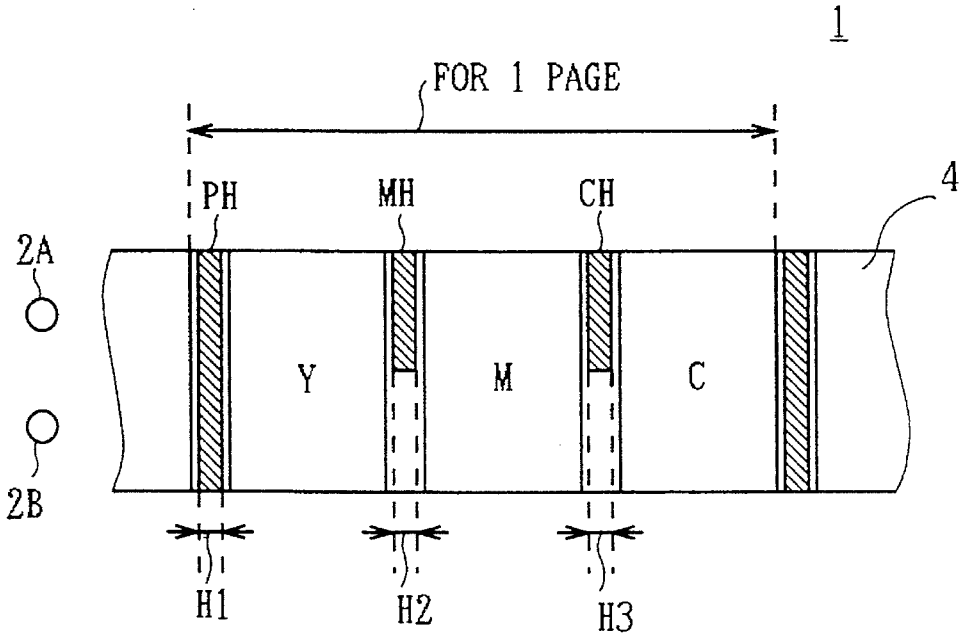
FIG. 1 (PRIOR ART)
FIG. 1 is a schematic plan diagram showing the conventional ink ribbon arrangement discussed in the opening paragraphs of this disclosure.
Figure 2:
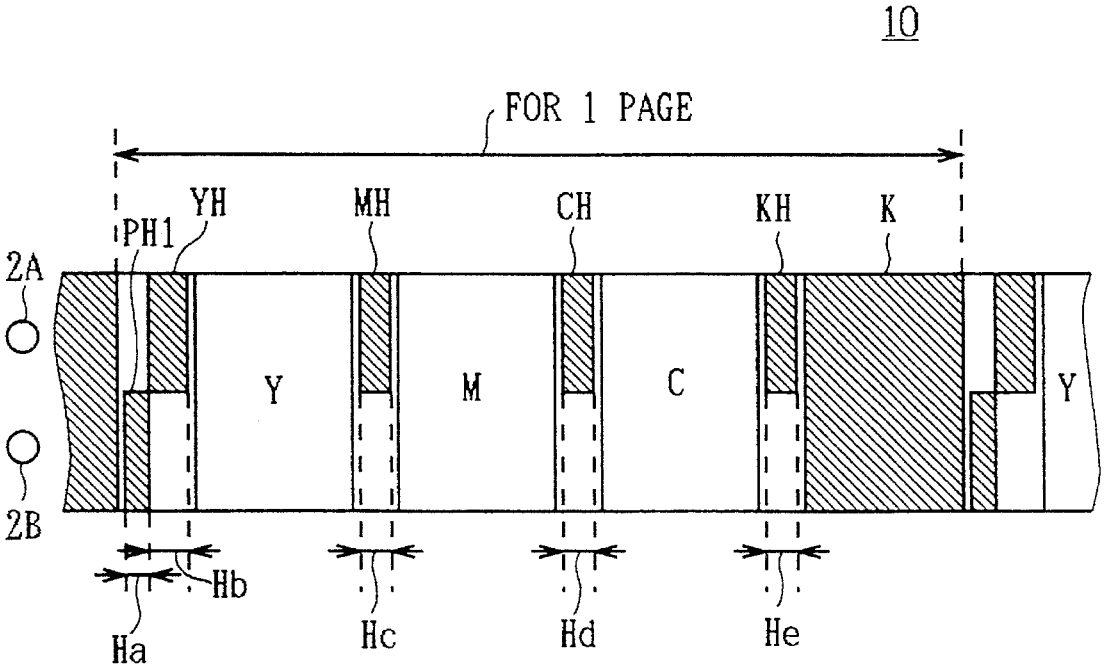
FIG. 2 is a schematic plan diagram showing an embodiment of the ink ribbon according to this invention.

Preferred embodiments of this invention will be described with reference to the accompanying drawings:

Referring to FIG. 2 wherein the portions corresponding to those in FIG. 1 are marked with the same reference numerals or characters, the numeral 10 generally designates an ink ribbon according to this invention, on which the yellow coloring dye Y, the magenta coloring dye M, the cyan coloring dye C, and the black coloring dye K are respectively applied along a predetermined length and the full width of a base 4, as the dye for one page. A unit header mark PH1, which is half the width of the ribbon, which is located on one side from the center in the longitudinal direction of the base 4, and which has a predetermined length Ha, is applied at the head portion for one page, that is to say, the portion immediately before the yellow coloring dye Y. The Y color mark YH, which is half the width of the ribbon is formed on the other side from the center of the ribbon. This mark YH has a predetermined length Hb and is formed so as to begin from the trailing inboard corner of the unit header mark PH1 in the illustrated manner.

The M color mark MH, the C color mark CH, and the black color mark KH, which respectively are half the width of the ribbon have predetermined lengths Hc, Hd, and He. These marks are formed at the heads of the coloring dyes M, C, and K, that is to say, between the coloring dyes Y and M, M and C, and C and K, and in a similar position to the Y color mark YH. The black dye K, the unit header mark PH1, the Y color mark YH, the M color mark MH, and the C color mark CH are different from other coloring dyes Y, M, and C, in that they are applied by a dye that is not transparent.

Figure 3:
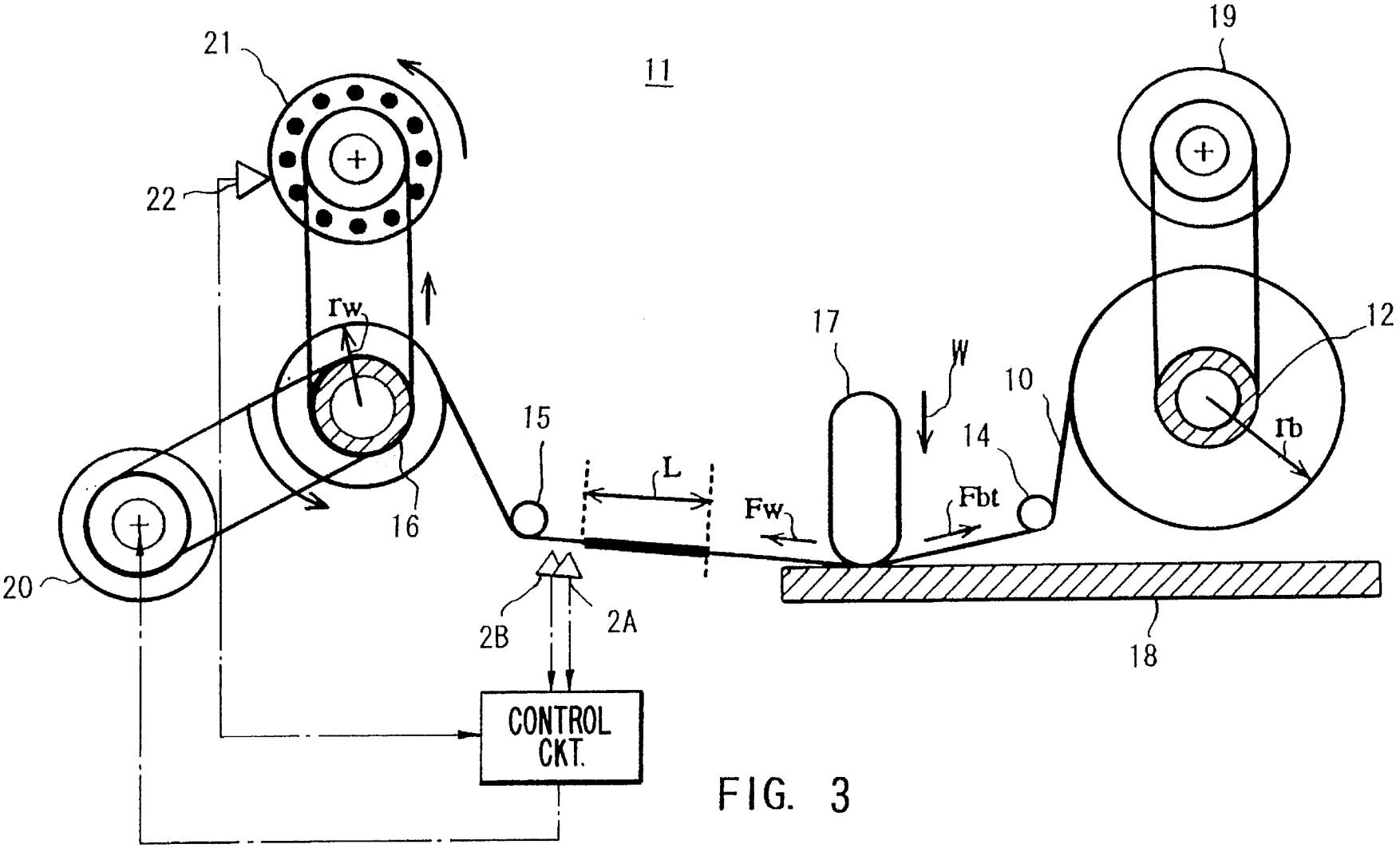
FIG. 3 is a schematic diagram showing the ink ribbon driving system using the ink ribbon depicted in FIG. 2.

An ink ribbon driving system 11 for driving the above described ink ribbon 10, is shown in FIG. 3. This system includes first and second sensors 2A and 2B, both of which are composed of the combination of a light emitting element and a light receiving element. These sensors are arranged so that when only the second sensor 2B senses a mark, that is to say, when the second sensor 2B does not sense reflected light, it is determined that the head of one page of the ink ribbon 10 has been detected. Thereafter, when only the first sensor 2A senses a mark, it is determined as the head of respective coloring dyes Y, M, C, and K has been detected.

In this way, even in the case where the black coloring dye K, having the same color as the respective color marks YH, MH, CN, and KH, is applied on the ink ribbon 10, when the position is to be determined as in finding the head of one page and each color, the position can be accurately determined and printing can be performed with high quality without the deleterious effects of ribbon length and slip. In the ink ribbon 10 of this embodiment, the Y color mark YH is also used as a winding diameter detection mark which shows, by way of its length, the winding diameter of the ink ribbon wound around one of reel 12 or 16.

In the ink driving system 11, the ink ribbon 10 is wound around a supply side reel 12 and is taken up on a take-up side reel 16 via ribbon guides 14 and 15. FIG. 3 shows a picture printing situation, wherein the ink ribbon 10 is pressed down on a card 18 with a predetermined weight and power W by a thermal copy head 17 which has been lowered down into the illustrated position.

A torque limiter 19 is connected with the supply side reel 12, so that a back tension Fbt is maintained in the ink ribbon 10 by the application of a fixed torque. The take-up side reel 16 is directly driven and controlled by a DC (direct current) motor 20. A winding diameter detecting encoder 21 composed of optical sensors and a sensor 22 are arranged in the manner illustrated in FIG. 3.

The ink ribbon driving system 11 includes a first sensor 2A which is arranged in a position suitable for detecting the Y color mark YH, the M color mark MH, the C color mark CH, and the black color mark KH and to issue an output indicative of the detection of the head of each color. A second sensor 2B is arranged in a position suitable for detecting the unit header mark PH1 and to issue an output indicative of a page having been detected. The first and second sensors 2A and 2B have an optical sensor composition. The first sensor 2A generates the first sensor output which rises to a high level when the respective color marks YH, MH, CH, and KH pass thereby. On the other hand, the second sensor 2B generates the second sensor output which assumes a high level when the unit header mark PH1 passes thereby.

With this arrangement, when the ink ribbon 10 is supplied and the head of each page is detected, the pulses of the encoder output generated by the sensor 22 of the winding diameter detecting encoder 21, are counted by a suitable circuit arrangement during the period that the winding diameter detecting mark, that is the Y color mark YH having a length Hb which is determined based on the diameter of the ink ribbon wound on one of the supply reels or the take-up reel, and which is formed at the head of each page on the base 4, is detected as passing the first sensor 2A.

Following this, the winding diameter of the ink ribbon 1 wound around the take-up side reel 16 is determined based on the count value, so as to vary the take-up torque of the DC motor 20 based on the winding diameter. Therefore, the power difference between the pull tension by the take-up side reel 16 and the back tension by the supply side reel 12 is controlled to a constant level, thereby enabling the realization of high quality printing.

With the above, the unit header finding mark PH1 which is half the width of the ribbon and which has a length Ha is formed at the head of one of the yellow coloring dye Y, the magenta coloring dye M, the cyan coloring dye C, and the black coloring dye K. The color header finding marks YH, MH, CH, and KH, which respectively are half the width of the ribbon are arranged on one side of the tape width so as to not overlap with the unit header finding mark PH1. These marks have predetermined lengths Hb, Hc, Hd, and He in the longitudinal direction and are formed at the heads of the respective coloring dyes Y, M, C, and K. Therefore, the head of one page and the head of each color are accurately detected in accordance with the output of the two sensors 2A and 2B so that the ink ribbon 10 having a simple constitution enables printing in high quality.

Further, in accordance with this embodiment, the length of the color header finding mark YH of the yellow coloring dye Y is also used as the winding diameter detecting mark, and the take-up torque of the DC motor 20 for driving the take-up side reel 16 is controlled based on the resultant winding diameter of the take-up side reel 16. Accordingly, the power difference between the pull tension by the take-up side reel 16 and the back tension by the supply side reel 12 is controlled to a constant level, thereby enabling the realization of high quality printing.

Further, in accordance with the above embodiment, since respective coloring dyes Y, M, C, and K are formed completely across the width of the base, the use efficiency of the base is improved compared with conventional ink ribbons in which the color marks, etc., are formed in the strips between the coloring dyes and the side edges of the base. Further, a wide sensing range is provided by this arrangement so that the sensors need not be located with great high accuracy. In this case, the winding diameter detecting marks, etc. must be formed at different positions in the longitudinal direction of respective coloring dyes and the base. However, as conventional ink ribbons use the intervals which are formed between respective coloring dyes to find the heads of respective coloring dyes, these intervals can be utilized to form the winding diameter detecting marks, etc. . . .

Further, in this embodiment, the color header finding mark YH of the yellow coloring dye Y is also used as the winding diameter detecting mark. However, this invention is not limited to this particular arrangement and the length of unit header mark PH1 may be varied and alternatively used as a winding diameter detecting mark.

In the embodiments discussed above, the color header finding mark YH of the yellow coloring dye Y is also used as the winding diameter detecting mark. However, this invention is not limited to this arrangement and if the take-up torque is not controlled by the wound length, the color header finding mark YH of the yellow coloring dye Y itself may be omitted and may be replaced by the unit header finding mark PH1.

Further, in the embodiments discussed above, the color header finding mark YH of the yellow coloring dye Y is formed next to the unit header finding mark PH1. However, this invention is not limited to this arrangement and the same effects with the above embodiments can be realized, even if there is a predetermined interval between the two marks.

Further, in the embodiments discussed above, the yellow coloring dye Y, the magenta coloring dye M, the cyan coloring dye C, and take black coloring dye K are respectively applied as the dye for one page. However, this invention is not limited to this, and is applicable to the case where the yellow coloring dye Y, the magenta coloring dye M, and the cyan coloring dye C are used as the dye for one page, and moreover the unit header finding mark and the color head finding mark are not only limited to the same dye with the black coloring dye, but other colors may be used.

Further, in the embodiments discussed above, the unit header finding mark and each color header finding mark are formed with a width half the ribbon width in the ribbon width direction. However, each mark form is not limited to this, and as long as the unit header finding mark and each color header finding mark are arranged so as to not overlap each other, the same effects as the above embodiments can be realized.

Further, in the embodiments discussed above, the unit header finding mark is put at the head of four kinds of coloring dyes. However, this invention is not limited to this, and the printing unit header finding mark may be put at the head of the predetermined printing unit.

Further, in the embodiments discussed above, the winding diameter detecting encoder of the ink ribbon driving system is provided in the take-up side reel. However, this invention is not limited to this, and the encoder may be provided in the supply side reel. In this case, the power difference between the tension for pulling the ink ribbon and the back tension can be controlled in the predetermined range similar to the above embodiments, thus the same effects can be obtained.

Further, in the embodiments discussed above, the winding diameter detecting encoder of the ink ribbon driving system is composed of an optical type sensor. However, this invention is not limited to this, and, if the rotating angle depending on the length of the winding diameter detecting mark on the ink ribbon can be detected, for example, a frequency generator using an MR element, or the like, may be used.

Furthermore, in the embodiments discussed above, this invention is applied to a card printing apparatus for color printing picture data on a card. However, this invention is not limited to this, and can be widely applied to printing apparatuses which use an ink ribbon, such as an apparatus for printing on a paper or other printing medium and a sublimation type printing apparatus, and is not limiting to thermal copy printing.

According to this invention described above, a printing unit header finding mark is formed at the head of the color ink areas having at least three kinds of colors. This header finding mark extends across the ribbon width direction and has a predetermined length in the longitudinal direction. Color header finding marks are formed at the head of the color ink areas having at least two kinds of colors except the color ink area following the printing unit header mark PH1, with a predetermined length in the longitudinal direction. The header finding mark PH1 and the color header finding marks are arranged so as to not overlap with the printing unit header finding mark in the ribbon width direction. Therefore, the head of printing unit and color ink areas can be detected in accordance with the output of two sensors in the manner described above, thereby realizing an ink ribbon which enables high quality printing and which has a simple constitution.

While the invention has been described in connection with the preferred embodiments of the invention, it will be obvious to those skilled in the art that various changes and modifications may be made and that the scope of the invention is limited only by the appended claims.

What is claimed is:

1. An ink ribbon, one end of which is wound around a supply reel and the other end of which is wound around a take-up reel, comprising:

a belt type base;

a plurality of sets of color ink areas formed repeatedly in a longitudinal direction along said base, each color ink area in each set of said color ink areas having a different color, respectively;

a unit header mark adapted to be detected by a first sensor formed between each set of color ink areas for indicating a beginning portion of each set of the color ink areas; and a plurality of color header marks adapted to be detected by a second sensor, each of said color header marks being formed between each said color ink areas for indicating a beginning portion of each said color ink areas, said color header marks being formed with respect to said unit head mark so that overlap in the width direction of said base is absent;

one of said plurality of color header marks being a diameter mark whose length in the longitudinal direction is varied so as to indicate the diameter of the ink ribbon wound around one of said supply reel and said take-up reel.

2. The ink ribbon according to claim 1, wherein:

said plurality of color header marks and said unit header mark have the same color.

3. The ink ribbon according to claim 2, wherein:

one of the color ink areas, said unit header mark and said color header mark each have the same color.

4. The ink ribbon according to claim 3, wherein:

the color of the one of the color ink areas, said unit header mark, and said color header mark is black.

5. The ink ribbon according to claim 1, wherein:

a beginning portion of said diameter mark is formed at the end portion of said diameter mark.

6. The ink ribbon according to claim 1, wherein each color ink area is formed so as to extend completely across the width of said base.

7. The ink ribbon according to claim 1, wherein:

said unit header mark is formed from one edge of said base to a center of said base in a lateral direction of said base and said color header mark is formed from a second edge of said base to the center of said base in the lateral direction of said base.

8. An ink ribbon, one end of which is wound around a supply reel and the other end of which is wound around a take-up reel, comprising:

a belt type base;

a plurality of sets of color ink areas formed repeatedly in a longitudinal direction along said base;

each color ink area in each set of color ink areas having a different color, respectively; and a diameter mark formed in each set of color ink areas, the length of each said mark in said longitudinal direction being indicative of the diameter of the ink ribbon wound around said supply reel or said take-up reel.

9. The ink ribbon according to claim 8, further comprising:

an unit header mark formed between each set of color ink areas for indicating a beginning portion of each set of the color ink areas.

10. The ink ribbon according to claim 9, further comprising:

a plurality of color header marks each formed at a beginning of one of said color ink areas for indicating a beginning portion of each of the color ink areas, said color header mark being formed with respect to said unit header mark so that overlap in the lateral direction of said base is absent.

11. The ink ribbon according to claim 10, wherein:

at least one of said color header marks is said diameter mark.

12. The ink ribbon according to claim 8, wherein:

each diameter mark is formed between each set of color ink areas.

13. The ink ribbon according to claim 9, wherein:

a color of said diameter mark and a color of said unit header mark are the same.

14. The ink ribbon according to claim 10, wherein:

a color of said diameter mark, said unit header mark and said color header mark are the same.

15. The ink ribbon according to claim 13, wherein:

a color of one of the color ink areas and a color of said diameter mark and a color of said color header mark are the same.

16. The ink ribbon according to claim 14, wherein:

a color of the one of the color ink areas, said diameter mark, said unit header mark, and said color header mark is black.

17. The ink ribbon according to claim 9, wherein:

said color ink area is formed completely across said base.

* * * * *